US008152251B2

(12) United States Patent
Huang et al.

(10) Patent No.: US 8,152,251 B2
(45) Date of Patent: Apr. 10, 2012

(54) SLIDE DETENT DEVICE

(75) Inventors: Shin Lung Huang, Kaohsiung Hsien (TW); Ken Ching Chen, Kaohsiung Hsien (TW); Chun Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 338 days.

(21) Appl. No.: 12/465,145

(22) Filed: May 13, 2009

(65) Prior Publication Data

US 2009/0284115 A1 Nov. 19, 2009

(30) Foreign Application Priority Data

May 16, 2008 (TW) ..... 97118307 A

(51) Int. Cl.
*A47B 88/04* (2006.01)

(52) U.S. Cl. ..... 312/334.44; 312/334.8

(58) Field of Classification Search ..... 312/330.1, 312/334.1, 334.7, 334.8, 334.11, 333, 334.44, 312/334.45, 334.46; 384/18, 20, 21
See application file for complete search history.

(56) References Cited

U.S. PATENT DOCUMENTS

| | | | | |
|---|---|---|---|---|
| 4,272,139 | A | 6/1981 | Fler | |
| 4,370,007 | A | 1/1983 | Fler | |
| 4,469,384 | A | 9/1984 | Fler et al. | |
| 4,537,450 | A | 8/1985 | Baxter | |
| 4,696,582 | A | 9/1987 | Kasten | |
| 4,932,792 | A * | 6/1990 | Baxter | 384/18 |
| 5,181,782 | A | 1/1993 | Wojcik | |
| 5,507,571 | A * | 4/1996 | Hoffman | 312/334.8 |
| 5,671,988 | A * | 9/1997 | O'Neill | 312/334.44 |
| 6,145,945 | A * | 11/2000 | Parvin | 312/334.46 |
| 6,244,678 | B1 | 6/2001 | Dopp et al. | |
| 6,254,209 | B1 * | 7/2001 | Parvin | 312/334.44 |
| 6,435,636 | B1 | 8/2002 | MacMillan | |
| 6,454,372 | B1 * | 9/2002 | Yang | 312/334.13 |
| 6,460,954 | B1 | 10/2002 | Bayani et al. | |
| 6,685,288 | B1 | 2/2004 | MacMillan | |
| 6,789,862 | B2 | 9/2004 | Shih-Long et al. | |
| 7,025,430 | B2 * | 4/2006 | Lauchner | 312/334.44 |
| 7,140,704 | B2 | 11/2006 | Chen et al. | |
| 2003/0117049 | A1 * | 6/2003 | Chang | 312/334.44 |

* cited by examiner

*Primary Examiner* — James O Hansen
(74) *Attorney, Agent, or Firm* — Rosenberg, Klein & Lee

(57) ABSTRACT

A slide detent device includes a second slide member slidably connected to a first slide member, and a stop member secured to the first slide member. A third slide member slidably connected to the second slide member includes a pair of third margins walls defining a pair of sliding raceways. The stop member includes a pair of extension wings corresponding to the pair of sliding raceways of the third slide member. The pair of extension wings has a pair of contacting surfaces. A distance defined between the pair of contacting surfaces is slightly smaller than a distance defined between the pair of the sliding raceways of the third slide member so that the pair of sliding raceways urges the contacting surfaces to form a locating effect of frictional contact when the pair of sliding raceways of the third slide member are in touch with the contact surfaces.

9 Claims, 7 Drawing Sheets

SLIDE DETENT DEVICE

BACKGROUND OF THE INVENTION

1. Field of the Invention

The present invention relates to a slide detent device, and more particularly to a slide detent device used on a piece of furniture, a cabinet or the like for providing a locating purpose after retraction.

2. Description of the Prior Art

There are a number of patents related to a slide detent device, such as U.S. Pat. Nos. 4,272,139; 4,370,007; 4,469,384; 4,537,450; 4,696,582; 5,181,782; 6,244,678; 6,435,636; 6,460,954; 6,685,288; 6,789,862; and 7,140,704. The aforesaid references are incorporated herein by reference.

It is obvious that those slide detent devices are functional. However, the designs are also complicated.

It is this inventor's concept that the detent device is to prevent the slide from loosening or disengaging if the furniture is either hitting by a foreign force or seating at an uneven location. The design is simple and costless.

SUMMARY OF THE INVENTION

The present invention provides a slide detent device to secure slide members in place after retraction.

According to a first aspect of the present invention, there is provided a slide detent device, comprising:

a first slide member;

a second slide member slidably connected to the first slide member;

a third slide member slidably connected to the second slide member, the third slide member comprising a pair of third marginal walls corresponding to each other, the pair of third marginal walls defining a pair of sliding raceways;

a first aid-sliding member disposed between the first slide member and the second slide member for facilitating the first slide member and the second slide member to slide with respect to each other;

a second aid-sliding member disposed between the second slide member and the third slide member for facilitating the first slide member and the second slide member to slide with respect to each other; and a stop member secured to the first slide member, the stop member comprising a pair of extension wings corresponding to the pair of sliding raceways of the third slide member, the pair of extension wings having a pair of contact surfaces thereon, a distance defined between the pair of contact surfaces being slightly smaller than a distance defined between the pair of sliding raceways of the third slide member.

According to a second aspect of the present invention, there is provided a slide detent device, comprising:

a first slide member comprising a pair of first marginal walls, a side wall extending between the pair of first marginal walls, and a channel defined among the pair of first marginal walls and the side wall;

a second slide member slidably connected to the channel of the first slide member; the second slide member comprising a pair of second marginal walls, the pair of second marginal walls defining a pair of sliding raceways;

a first aid-sliding member disposed between the first slide member and the second slide member for facilitating the first slide member and the second slide member to slide with respect to each other; and a stop member secured to the first slide member, the stop member comprising a pair of extension wings corresponding to the pair of sliding raceways of the second slide member, the pair of extension wings having a pair of contact surfaces thereon, a distance defined between the pair of contact surfaces being slightly smaller than a distance defined between the pair of sliding raceways of the second slide member.

According to a third aspect of the present invention, there is provided a detent device for a slide assembly, the slide assembly comprising a plurality of slide members slidably connected to each other, the detent device comprising:

a stop member secured to one of the plurality of slide members, the other of the plurality of slide members each comprising a pair of marginal walls, the pair of marginal walls defining a pair of sliding raceways; and a pair of extension wings extending from the stop member, the pair of extension wings having a pair of contact surfaces;

wherein a distance defined between the pair of contact surfaces is slightly smaller than a distance defined between the pair of sliding raceways of the other of the plurality of slide members, when the other of the plurality of slide members are retracted toward the stop member, the pair of sliding raceway of the other of the plurality of slide members being in touch with the pair of contact surfaces and slightly pushing the pair of contact surfaces to be located thereat.

DETAILED DESCRIPTION OF PREFERRED EMBODIMENTS

Figure 1:
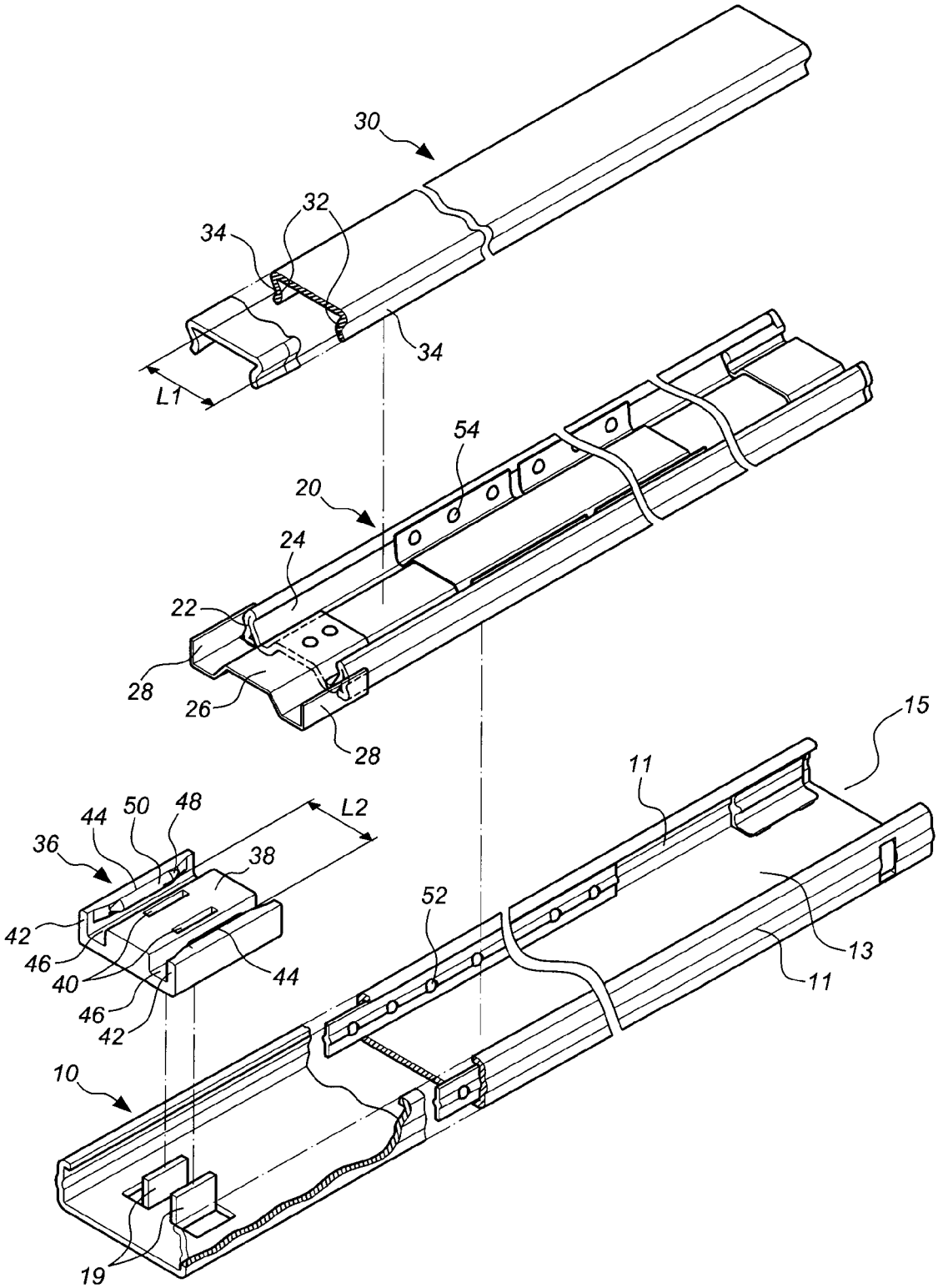
FIG. 1 is an exploded view of a first preferred embodiment of the present invention.
Figure 2:
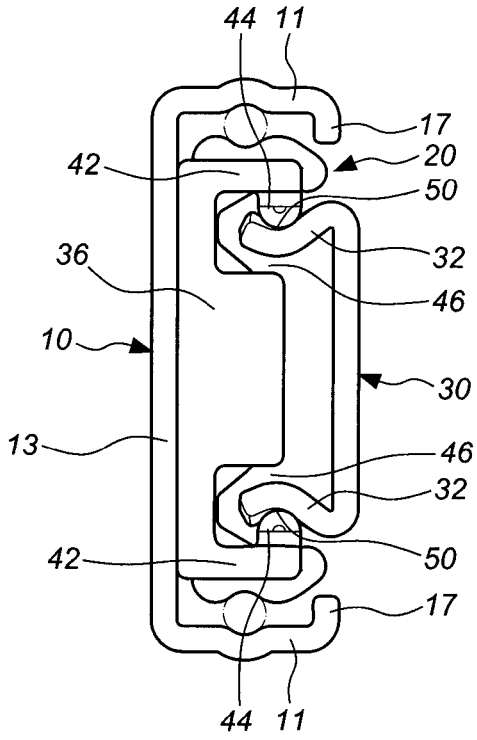
FIG. 2 is a partial view of the first preferred embodiment of the present invention.

As shown in FIGS. 1 and 2, a slide detent device of a first preferred embodiment of the present invention comprises a first slide member 10, a second slide member 20, a holding member 26, a stop member 36, a third slide member 30, a first aid-sliding member 52, and a second aid-sliding member 54.

The first slide member 10 comprises a pair of first marginal walls 11 corresponding to each other, a side wall 13 extending between the pair of first marginal walls 11, a channel 15 defined among the pair of first marginal walls 11 and the side wall 13, and a pair of bend sections 17 extending from the pair of first marginal walls 11, respectively. In this embodiment, a terminal end of the side wall 13 of the first slide member 10 is formed with a pair of supporting plates 19.

The second slide member 20 is slidably connected to the channel 15 of the first slide member 10. The second slide member 20 comprises a pair of second marginal walls 22 corresponding to each other, each defining a sliding raceway 24 thereon.

The holding member 26 is secured to one end of the second slide member 20. The holding member 26 comprises a pair of holding portions 28 located adjacent to the pair of second marginal walls 22, respectively.

The third slide member 30 is slidably connected to the second slide member 20. The third slide member 30 comprises a pair of third marginal walls 32 each defining a sliding raceway 34. In this embodiment, the distance between the pair of sliding raceways 34 is defined L1.

The stop member 36 is secured to the first slide member 10. In this embodiment, the stop member 36 has a base 38 with a pair of slits 40 corresponding to the supporting plates 19 of the first slide member 10 for insertion therein to hold the stop member 36 on the first slide member 10 securely. The stop member 36 further comprises a pair of extension arms 42 and a pair of extension wigs 44 transversely extending from the pair of extension arms 42, respectively. A pair of sliding channels 46 is defined between the pair of extension arms 42 and the base 38 for the pair of sliding raceways 34 of the third slide member 30 to slide thereon. The pair of extension wings 44 corresponds to the pair of sliding raceways 34 of the third slide member 30. In this embodiment, each of the pair of extension wings 44 has a guiding surface 48 and a contact surface 50 extending from the guiding surface 48. The guiding surface 48 is adapted to lead sliding of the pair of sliding raceways 34. In this embodiment, a distance between the contact surfaces 50 of the pair of extension wings 44 is defined L2 which is slightly smaller than the distance L1 between the pair of sliding raceways 34 of the third slide member 30. When the pair of sliding raceways 34 of the third slide member 30 is in touch with the pair of contact surfaces 50, the pair of sliding raceways 34 will slightly push the pair of contact surfaces 50 for providing a locating effect of friction contact, as shown in FIG. 2. In this embodiment, the stop member 36 is made of plastic material.

The first aid-sliding member 52 is disposed between the first slide member 10 and the second slide member 20. The first aid-sliding member 52 comprises a number of bearings, rollers or the like to facilitate sliding movement of the first slide member 10 and the second slide member 20.

The second aid-sliding member 54 is disposed between the second slide member 20 and the third side member 30. The second aid-sliding member 54 comprises a number of bearings, rollers or the like to facilitate sliding movement of the second slide member 20 and the third slide member 30.

Figure 3:
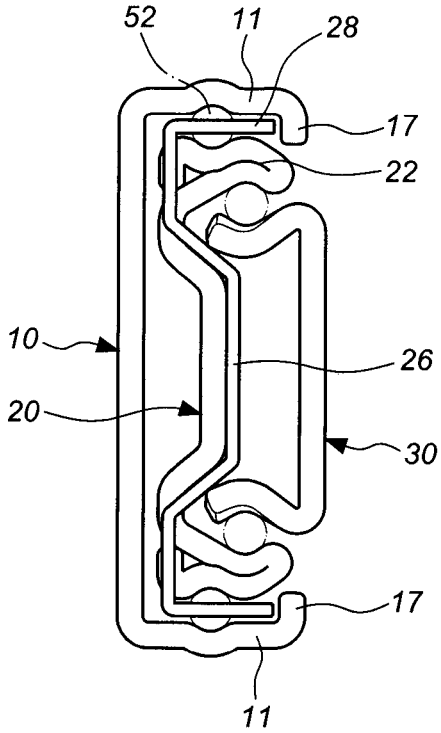
FIG. 3 is a partial view of the first preferred embodiment of the present invention with a holding member incorporated therein.

FIG. 3 is a partially cross-sectional view of the first preferred embodiment of the present invention. The pair of holding portions 28 of the holding member 26 is located adjacent to the pair of second marginal walls 22 of the second slide member 20. When the second slide member 20 is extended to its extremity in the first slide member 10, the holding member 26 will engage with the first aid-sliding member 52 to restrain the movement of the second slide member 20. The edges of the pair of holding portions 28 are adjacent to the pair of bend sections 17 so that when struck by an unexpected force, the pair of holding portions 28 will hold against the pair of the bend sections 17 to prevent disengagement of the second slide member 20 and the first slide member 10.

Figure 4:
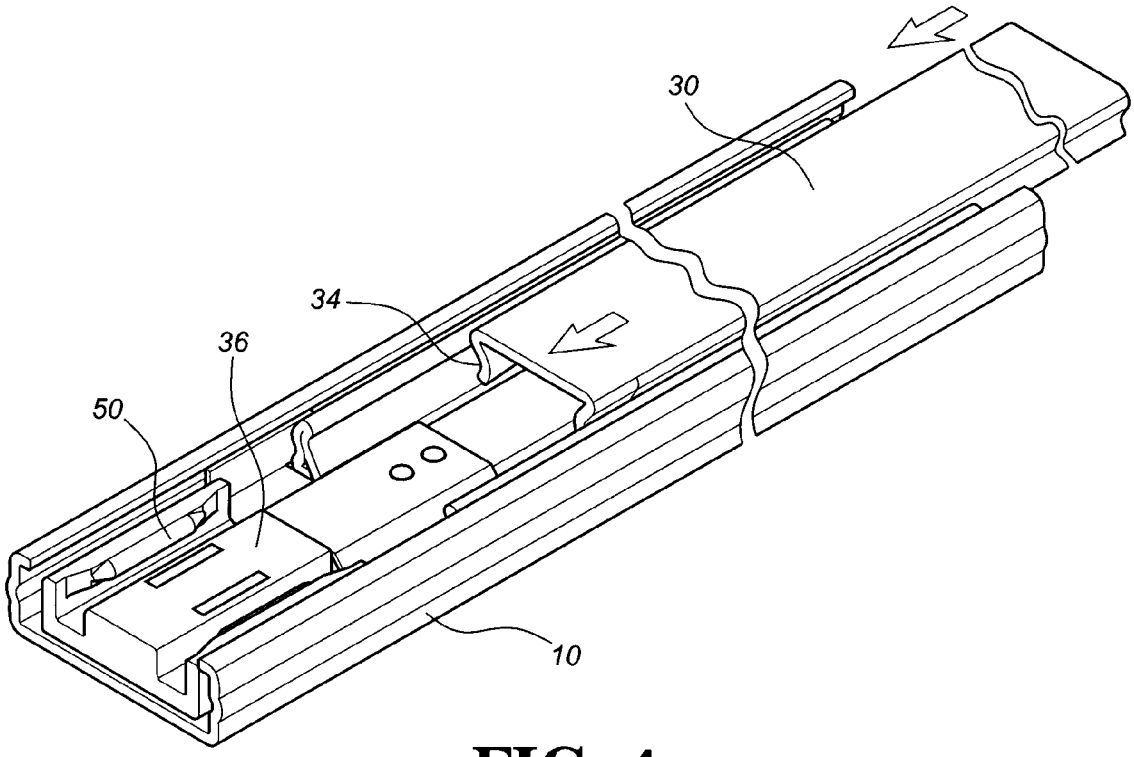
FIG. 4 is a perspective view of the first preferred embodiment of the present invention.
Figure 5:
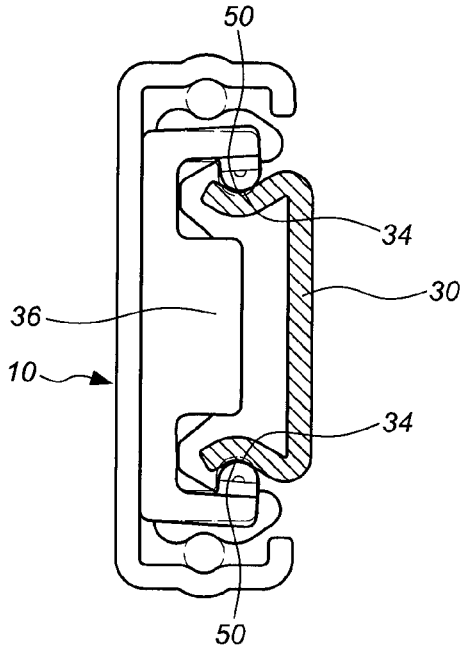
FIG. 5 is a cross-sectional view of the first preferred embodiment of the present invention.

FIG. 4 is a perspective view of the first preferred embodiment of the present invention. FIG. 5 is a cross-sectional view of the first preferred embodiment of the present invention. When the third slide member 30 is retracted to a predetermined position with respect to the first slide member 10, the pair of sliding raceways 34 of the third slide member 30 will be in touch with the pair of contact surfaces 50 of the stop member 36 and then restrained by the stop member 36 from any further movement.

Accordingly, when the third slide member 30 is retracted in the first slide member 10, this embodiment provides an immovable effect, preventing the third slide member 30 from sliding freely. For instance, if the furniture is standing on an uneven ground, the third slide member 30 may slide away from the first slide member 10. To release the immovable status of the first slide member 10 and the third slide member 30, simply pull the third slide member 30 away from the first slide member 10 to get rid of the friction contact between the first slide member 10 and the third slide member 30 so that the first slide member 10 and the third slide member 30 are restored to slide.

Figure 6:
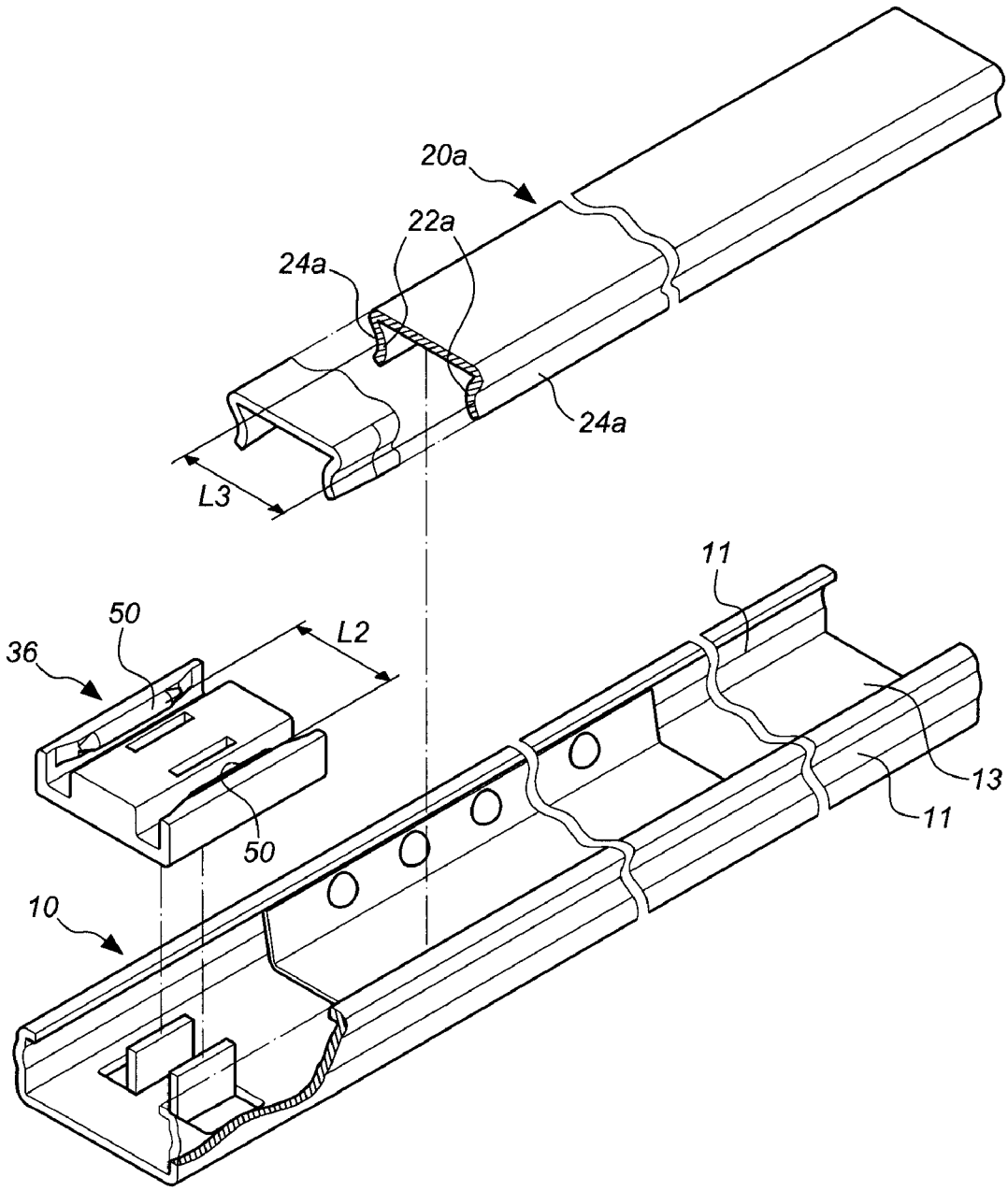
FIG. 6 is an exploded view of a second preferred embodiment of the present invention.

FIG. 6 is an exploded view of a second preferred embodiment of the present invention, which is substantially similar to the first preferred embodiment, with the exceptions described hereinafter. The second preferred embodiment comprises a first slide member 10 and a second slide member 20*a*.

The first slide member 10 comprises a pair of first marginal walls 11 corresponding to each other and a side wall 13 extending between the pair of first marginal walls 11.

The second slide member 20*a* is slidably connected to the first slide member 10. The second slide member 20*a* comprises a pair of second marginal walls 22*a* corresponding to each other, each defining a sliding raceway 24*a* thereon. The pair of sliding raceways 24*a* is defined a distance L3 which is slightly bigger than the distance L2 between the contact surfaces 50 of the stop member 36.

Figure 7:
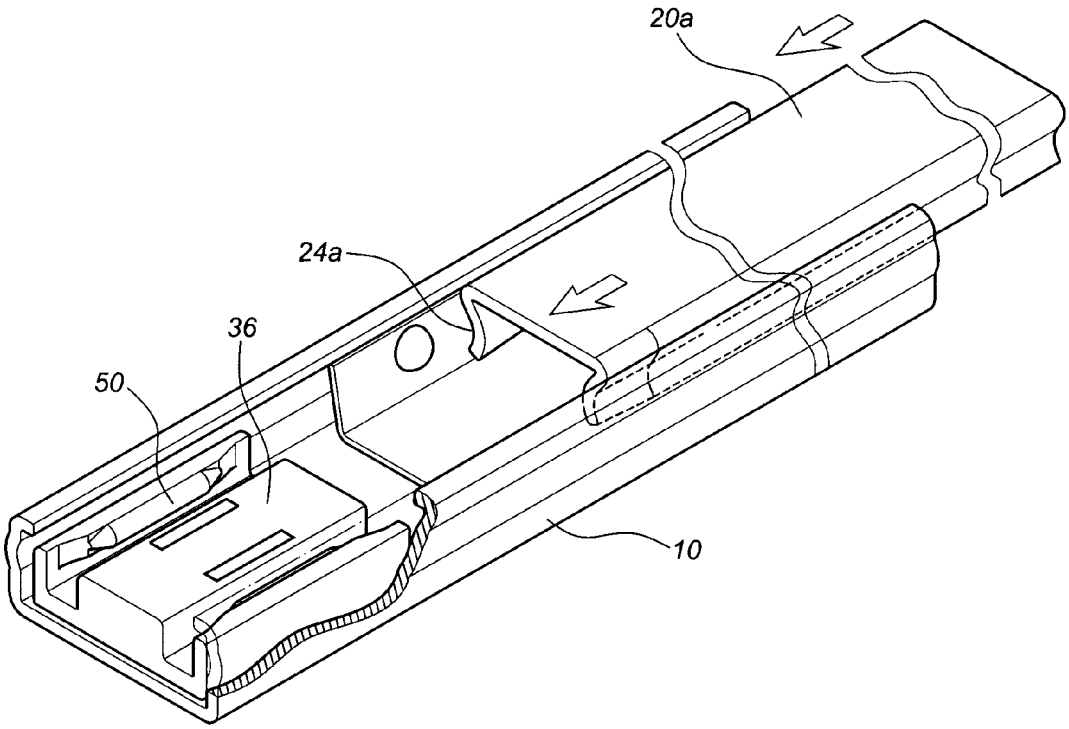
FIG. 7 is a perspective view of the second preferred embodiment of the present invention.
Figure 8:
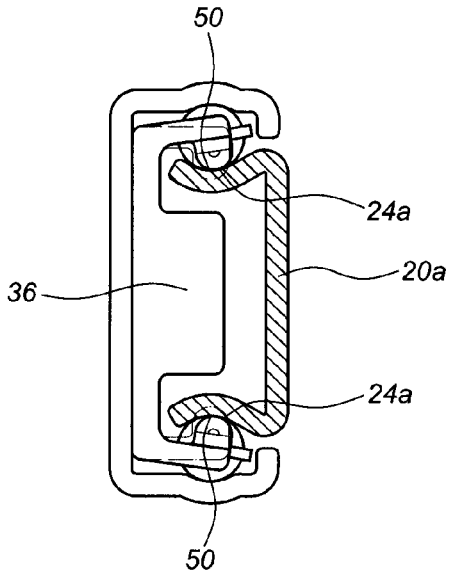
FIG. 8 is a cross-sectional view of the second preferred embodiment of the present invention.

FIG. 7 is a perspective view of the second preferred embodiment of the present invention. FIG. 8 is a cross-sectional view of the second preferred embodiment of the present invention. When the second slide member 20*a* is retracted to a predetermined position in the first slide member 10, the pair of sliding raceways 24*a* of the second slide member 20*a* will be in touch with the contact surfaces 50 of the stop member 36 and be restrained by the stop member 36 from any further movement.

Accordingly, when the second slide member 20*a* is retracted in the first slide member 10, this embodiment provides an immovable effect, preventing the second slide member 20*a* from sliding freely. For instance, if the furniture is standing on an uneven ground, the second slide member 20*a* may slide away from the first slide member 10. To release the immovable status of the first slide member 10 and the second slide member 20*a*, simply pull the second slide member 20*a* away from the first slide member 10 to get rid of the friction contact between the first slide member 10 and the second slide member 20*a* so that the first slide member 10 and the second slide member 20*a* are restored to slide.

Figure 9:
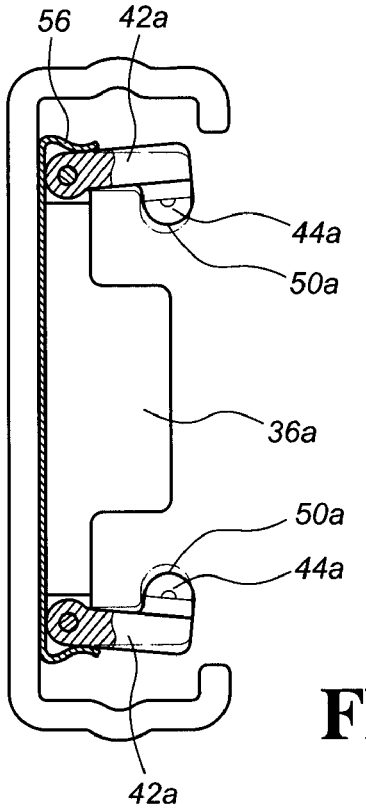
FIG. 9 is a schematic view showing a stop member of a third preferred embodiment of the present invention.

FIG. 9 is a schematic view showing a stop member of a third preferred embodiment of the present invention. In this embodiment, a stop member 36*a* comprises a pair of extension arms 42*a* corresponding to each other and a pair of extension wings 44*a* extending from the pair of extension arms 42*a* transversely. Each extension arm 42*a* is pivotally connected to the stop member 36*a*. Each extension wing 44*a* has a contact surface 50*a*. The stop member 36*a* is provided with an elastic member 56 for urging the pair of extension arms 42*a* inward.

The stop member 36*a* is also appropriate to be used in the first and second preferred embodiments of the present invention for providing a better friction.

Figure 10:
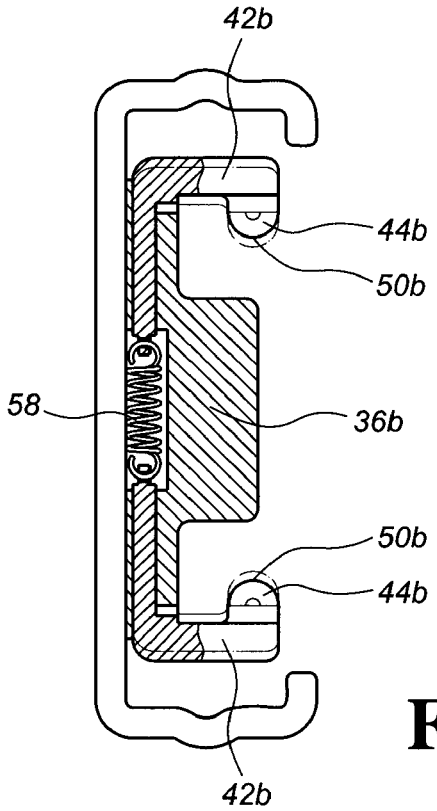
FIG. 10 is a schematic view showing a stop member of a fourth preferred embodiment of the present invention.

FIG. 10 is a schematic view showing a stop member of a fourth preferred embodiment of the present invention. In this embodiment, a stop member 36*b* comprises a pair of extension arms 42*b* and a pair of extension wings 44*a* connected to the pair of extension arms 42*b*, respectively. The pair of extension arms 42*a* is slidably connected to the stop member 36*b*. Each extension wing 44*b* has a contact surface 50*b*. An elastic member 56*b* is provided between the pair of extension arms 42*b* for urging the pair of extension arms 42*b* inward.

The stop member 36*b* is also appropriate to be used in the first and second preferred embodiments of the present invention.

Figure 11:
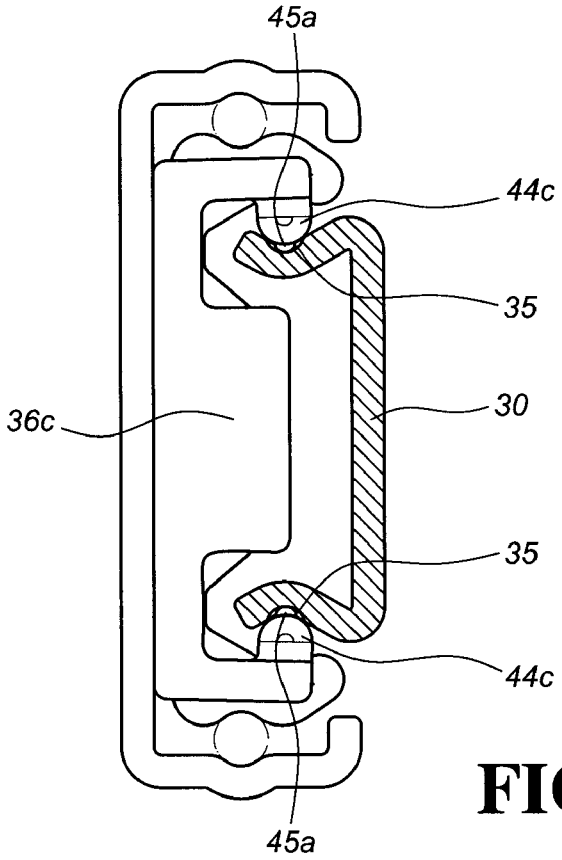
FIG. 11 is a schematic view showing a stop member of a fifth preferred embodiment of the present invention.

FIG. 11 is a schematic view showing a stop member of a fifth preferred embodiment of the present invention. In this embodiment, the slide assembly is in the form of three-section. A stop member 36*c* comprises a pair of extension wings 44*c* each provided with a protruding portion 45*a*. The third slide member 30 is formed with a concave portion 35 corresponding to the protruding portion 45*a*. When the third slide member 30 is pushed inward to a predetermined position, the protruding portion 45*a* will engage with the concave portion 35 to hold the third slide member 30 securely.

Figure 12:
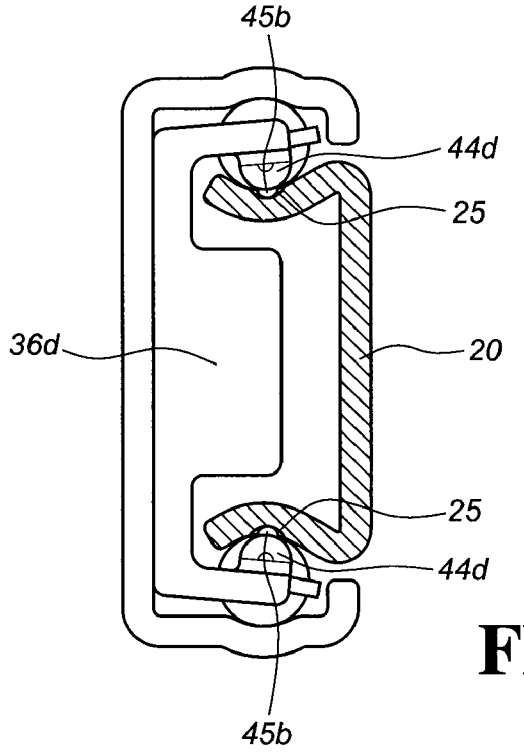
FIG. 12 is a schematic view showing a stop member of a six preferred embodiment of the present invention.

FIG. 12 is a schematic view showing a stop member of a sixth preferred embodiment of the present invention. In this embodiment, the slide assembly is in the form of two-section. A stop member 36*d* comprises a pair of extension wings 44*d* each provided with a protruding portion 45*b*. The second slide member 20 is formed with a concave portion 25 corresponding to the protruding portion 45*b*. When the second slide member 20 is pushed inward to a predetermined position, the protruding portion 45*b* will engage with the concave portion 25 to hold the second slide member 20 securely.

The present invention as mentioned above may be applied to a piece of furniture, a cabinet, or the like to hold the closet securely and effectively.

What is claimed is:

1. A slide detent device, comprising:

a first slide member;

a second slide member slidably connected to the first slide member;

a third slide member slidably connected to the second slide member, the third slide member comprising a pair of third marginal walls corresponding to each other, the pair of third marginal walls defining a pair of sliding raceways;

a first aid-sliding member disposed between the first slide member and the second slide member for facilitating the first slide member and the second slide member to slide with respect to each other;

a second aid-sliding member disposed between the second slide member and the third slide member for facilitating the second slide member and the third slide member to slide with respect to each other; and a stop member secured to the first slide member, the stop member comprising a pair of extension wings corresponding to the pair of sliding raceways of the third slide member, the pair of extension wings having a pair of contact surfaces thereon, a distance defined between the pair of contact surfaces being slightly smaller than a distance defined between the pair of sliding raceways of the third slide member;

wherein the second slide member comprises a pair of second marginal walls and a holding member, the holding member comprising a pair of holding portions located adjacent to the second marginal walls, when the second slide member is extended to its extremity, the holding member engaging with the first aid-sliding member to restrain the second slide member from movement.

2. The slide detent device as claimed in claim 1, wherein a terminal end of a side wall of the first slide member is formed with a pair of supporting plates, the stop member having a base, the base having a pair of slits for insertion of the pair of supporting plates of the first slide member, the stop member being secured to the first slide member.

3. The slide detent device as claimed in claim 1, wherein the stop member is made of plastic material.

4. The slide detent device as claimed in claim 1, wherein the stop member comprises a base and a pair of extension arms, the base and the extension arms defining a pair of sliding channels for the third slide member to slide along the sliding channels.

5. The slide detent device as claimed in claim 1, wherein the pair of extension wings each has a guiding surface to lead sliding of the pair of sliding raceways of the third slide member.

6. The slide detent device as claimed in claim 1, wherein the first slide member comprises a pair of first marginal walls, the pair of first marginal walls having a pair of bend sections extending from edges of the first marginal walls inward, the holding member having a pair of edges adjacent to the pair of bend sections of the first slide member.

7. The slide detent device as claimed in claim 1, further comprising a pair of extension arms pivotally connected to the stop member and an elastic member coupled to the stop member, the pair of extension arms extending from the pair of extension wings respectively, the elastic member being adapted to urge the pair of extension arms inward.

8. The slide detent device as claimed in claim 1, further comprising a pair of extension arms and an elastic member connected between the pair of extension arms, the pair of extension arms extending from the pair of extension wings respectively, the elastic member being adapted to urge the pair of extension arms inward.

9. The slide detent device as claimed in claim 1, wherein one of the pair of third marginal walls of the third slide member is formed with a concave portion, the pair of extension wings of the stop member comprising a protruding portion corresponding to the concave portion of the third slide member, the concave portion engaging with the protruding portion after retraction of the third slide member.

* * * * *